US009592935B1

(12) United States Patent
Jacob et al.

(10) Patent No.: US 9,592,935 B1
(45) Date of Patent: Mar. 14, 2017

(54) SCREW-TYPE CONTAINER-CLOSURE SYSTEMS WITH MAGNETIC FEATURE

(71) Applicant: ELC Management LLC, Melville, NY (US)

(72) Inventors: Christophe Jacob, Paris (FR); Herve Bouix, New York, NY (US)

(73) Assignee: ELC Management, LLC, Melville, NY (US)

( * ) Notice: Subject to any disclaimer, the term of this patent is extended or adjusted under 35 U.S.C. 154(b) by 60 days.

(21) Appl. No.: 14/865,074

(22) Filed: Sep. 25, 2015

(51) Int. Cl.
*A45D 40/26* (2006.01)
*B65D 41/04* (2006.01)

(52) U.S. Cl.
CPC ..... *B65D 41/0407* (2013.01); *A45D 40/267* (2013.01)

(58) Field of Classification Search
CPC ..... A45D 40/265
USPC ..... 401/100, 118, 121, 122, 123, 124, 126, 401/127, 128, 129, 130
See application file for complete search history.

(56) References Cited

U.S. PATENT DOCUMENTS

| | | | | |
|---|---|---|---|---|
| 6,382,450 | B1 | 5/2002 | DeRosa et al. | |
| 6,866,437 | B2 | 3/2005 | Gueret | |
| 8,348,061 | B2 | 1/2013 | Komatsuda et al. | |
| 8,424,703 | B2 | 4/2013 | Meulen | |
| 8,443,993 | B1 | 5/2013 | Desselle | |
| 8,636,167 | B2 | 1/2014 | Hajichristou et al. | |
| 8,851,534 | B2 | 10/2014 | Fiedler | |
| 2011/0073601 | A1 | 3/2011 | Komasuda et al. | |
| 2011/0297173 | A1 * | 12/2011 | Anderson | A45D 40/18 132/218 |

FOREIGN PATENT DOCUMENTS

| | | | |
|---|---|---|---|
| FR | 2973004 | A1 | 9/2012 |
| FR | 2973005 | A1 | 9/2012 |

* cited by examiner

*Primary Examiner* — David Walczak
*Assistant Examiner* — Joshua Wiljanen
(74) *Attorney, Agent, or Firm* — Peter Giancana

(57) ABSTRACT

A screw-type closure system comprising a container and closure. The closure comprises a screw-threaded inner cap, a customized wand that depends from the inner cap and supports an applicator surface, an overcap that is enabled to translate axially relative to the inner cap, and one or more magnetic elements. The container comprises a specialized shoulder, a neck having a specialized screw thread profile, a customized wiper that engages the customized wand, an overshell that houses one or more magnetic elements that tend to attract the one or more magnetic elements of the closure.

The closure is screwed onto the container until the inner cap comes to a hard stop, at which point the magnetic elements of the closure are aligned with the magnetic elements of the container. At that point, the overcap (15) of the closure (11) is drawn toward the overshell (4) of the container until they make contact, so that there is no unsightly gap. Also, the contact produces a satisfying, reassuring metallic "click" sound, accompanied by a luxurious tactile sensation.

14 Claims, 11 Drawing Sheets

SCREW-TYPE CONTAINER-CLOSURE SYSTEMS WITH MAGNETIC FEATURE

FIELD OF THE INVENTION

The present invention pertains to screw-type container-closure systems, where the closure rotates relative to the container while being mounted and demounted from the container. More specifically, the invention pertains to container-closure systems wherein the closure is able to register precisely with the container and any gap between the two is eliminated.

BACKGROUND

Container-closure systems wherein a closure is rotated relative to a container while being mounted and demounted from the container are well known. Examples of these include containers and closures with complementary screw threads. The closure and container are drawn together through their relative rotation. Typically, the rotation stops and the closure is fully mounted on the container when some portion of the closure bottoms out on some portion of the container. Preferably, at that point the closure makes an effective fluid tight seal on the container, while at the same time, there is no discernible gap between the closure and the container. This is not always easy to achieve, however, and it is often the case that when a closure is fully mounted on a container there is a gap between the closure and container. This gap disturbs the aesthetic appeal of the package. The situation is worse if the container and closure have to align with each other in a precise fashion. For example, if the cross sections of the container and closure are not round (square, for example), then in order for the package to have a smoothly flowing shape, the container and closure must register precisely so that the cross section of the assembled package is continuous from container to closure. Furthermore, when a closure is screwed down onto a container, and reaches the point where it is fully mounted onto the container, this event is generally silent, and presents no interest for the user.

OBJECTS OF THE INVENTION

A main objective of the invention is to eliminate the gap between the closure and container in screw-threaded closure systems.

Another objective is to provide a way for the container and closure to register precisely with each other when the package is sealed.

Another objective of the invention is to make dull rotating closures a thing of the past by providing a luxury experience to consumers.

SUMMARY

The present challenges are met by a container (10) and closure (11) as described, herein. The closure comprises a screw-threaded inner cap (12); a wand (13) that depends from the inner cap and supports an applicator surface (14); an overcap (15) that is enabled to translate axially, relative to the inner cap; and one or more magnetic elements (19). The container (10) comprises a specialized shoulder (1*a*); a neck (1*g*) having a specialized screw thread profile; an overshell (4) that houses one or more magnetic elements (9) that tend to attract the one or more magnetic elements (19) of the closure.

The closure (11) is screwed onto the container (10) in the usual manner, until the inner cap comes to a hard stop, at which point the magnetic elements of the closure are aligned with the magnetic elements of the container. At that point, the overcap (15) of the closure (11) is drawn toward the overshell (4) of the container until they make contact, so that there is no unsightly gap. Also, the contact produces a satisfying, reassuring metallic "click" sound, accompanied by a luxurious tactile sensation that, together, dispel the silent ennui normally associated with rotating closures.

DETAILED DESCRIPTION

Throughout the specification, the term "magnetic elements" means a material that has permanent magnetization or one that can acquire a magnetization (i.e. a ferromagnetic material).

Figure 1:
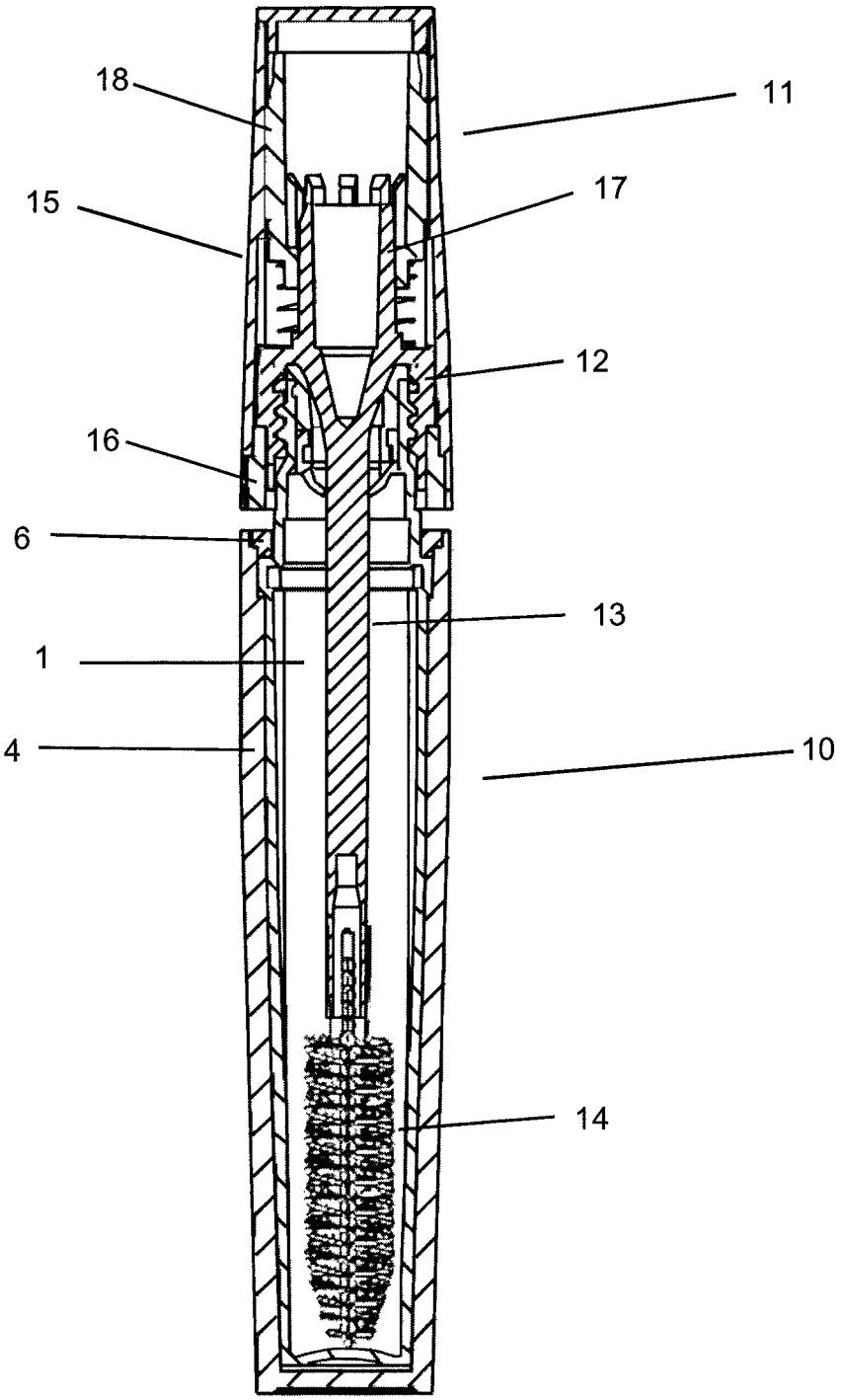
FIG. 1 is a cross sectional elevation view a screw-type closure system with magnetic feature according to the present invention.

FIG. 1 represents a preferred embodiment of the invention. As we will see, the reservoir (1), the container overshell (4) and the collar (6) move as one. Those three components form a first subassembly. The overcap (15), the cap insert (16) and the hollow cylinder (18) also move as one. Those three components form a second subassembly. The inner cap (12), the wand (13), the applicator surface (14) and the piston (17) also move as one. Those components form a third subassembly.

Container

Figure 2A:
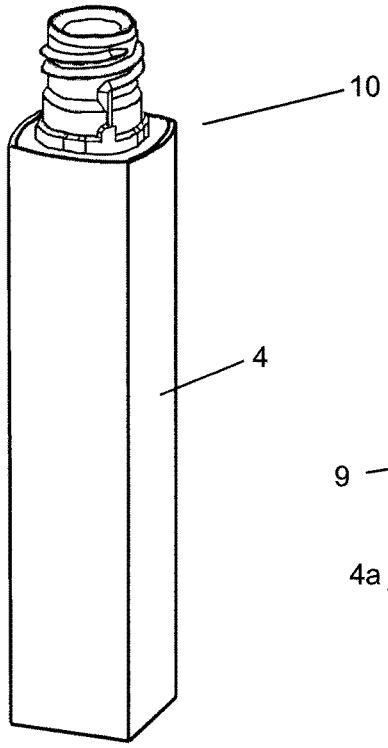
FIG. 2A is a perspective view of a container (10) according to the present invention.
Figure 2B:
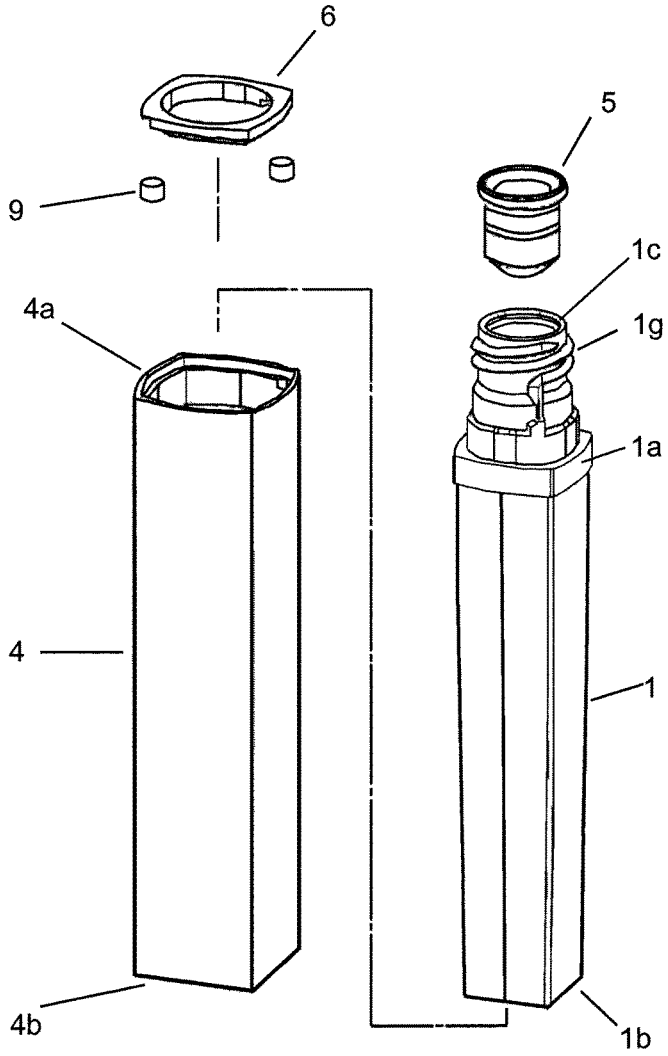
FIG. 2B is an exploded view thereof.

Referring to FIGS. 2A and 2B, one embodiment of a container (10) according to the present invention comprises a reservoir (1), an overshell (4), and a collar (6) that houses one or more magnetic elements (9).

Reservoir

The reservoir (1) is able to be filled with a product, for example a personal care product such as mascara, or essentially any type of product. The cross section of the reservoir is shown as uniform along its height and approximately square, but other shapes are possible. The distal end (1*b*) of the reservoir is closed, and the proximal end (1*c*) is opened to allow access to the product on the interior of the reservoir. A wiper (5) will typically be deployed inside the proximal opening of the reservoir, as is generally the case with wand-type applicator packages.

Figure 3A:
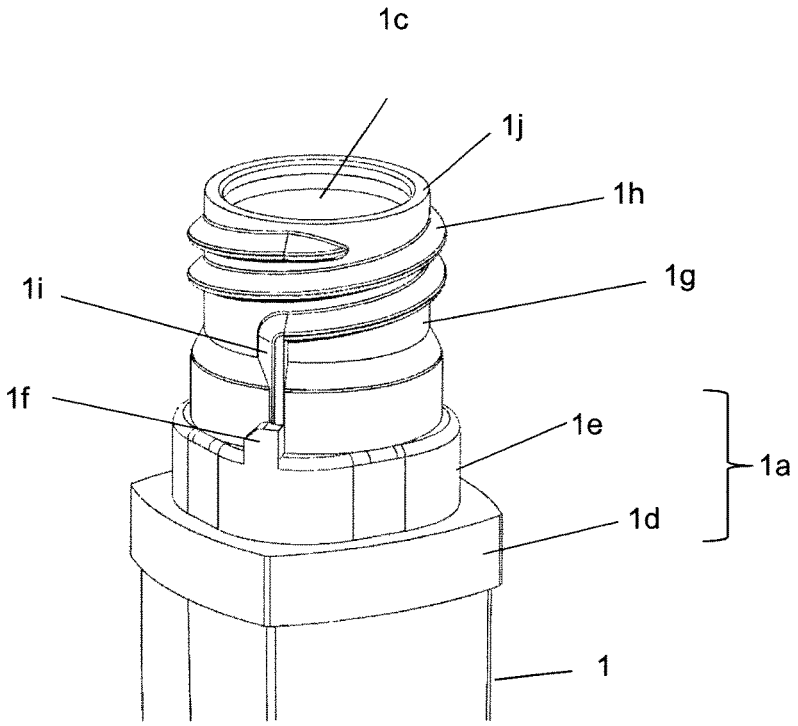
FIGS. 3A and 3B depict the container stops (1*f*) and the down turned thread of the container (10).
Figure 3B:
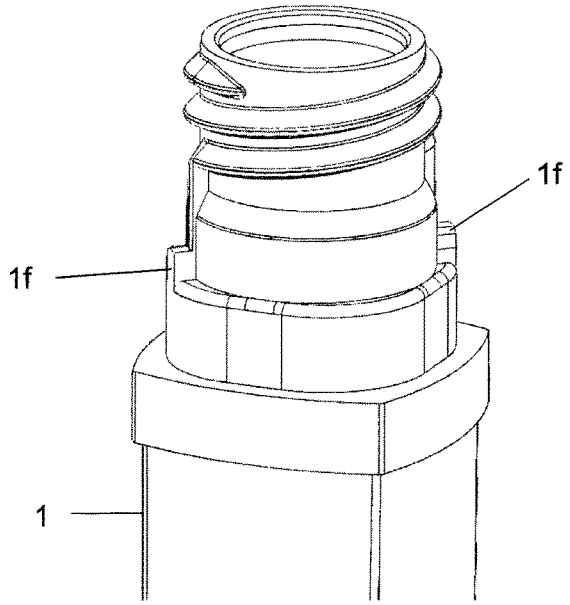

Referring to FIGS. 3A and 3B, the reservoir (1) is provided with a specialized shoulder (1*a*) closer to its proximal end (1*c*). The shoulder of the reservoir comprises elements (1*d*), (1*e*) and (1*f*). (1*d*) denotes a wider section of the shoulder whose lateral dimension (i.e. width or radius, as the case may be) is greater than the lateral dimension of the reservoir. (1*e*) denotes a narrower section whose lateral dimension is smaller than the lateral dimension of the reservoir. (1*f*) denotes a container stop that rises from the top of the shoulder (i.e. from the top of the narrower section, 1*e*). More than one container stop may be provided, spaced around the shoulder. For example, two container stops may be positioned 180° apart, as shown. Also rising from the top of the shoulder (1*a*) is the threaded neck (1*g*) of the reservoir (1). The screw threads (1*h*) of the neck are typical, except at the end (1*i*) thereof, where the thread is turned abruptly downward, in line with one of the container stops (1*f*). The reservoir, shoulder and neck are preferably fashioned as one integrally molded component.

Overshell and Collar

Figure 4A:
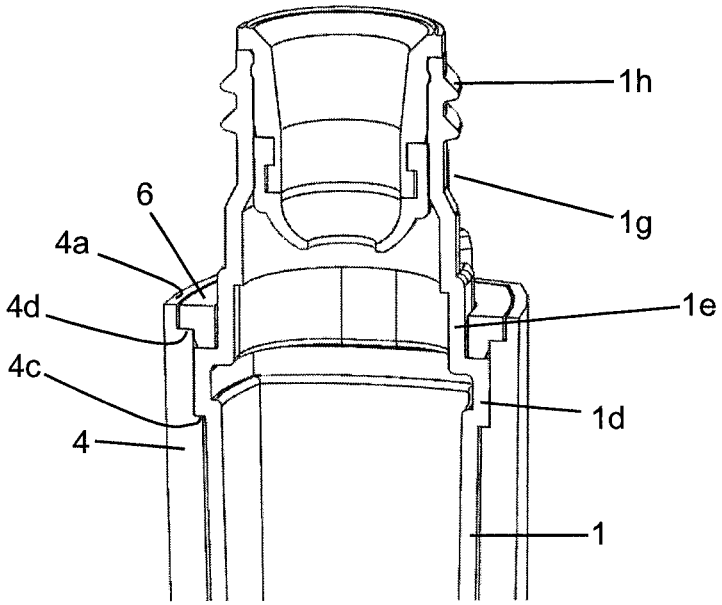
FIGS. 4A and 4B show the reservoir (1) and shoulder (1*a*) of the container (10) disposed in the container overshell (4).

Referring to FIG. 2B, the reservoir (1) and shoulder (1*a*) of the container (10) are designed to fit inside a container overshell (4), which may be of similar or different cross section as the reservoir. The container overshell has a closed bottom (4*b*) and an opened top (4*a*). Referring to FIG. 4A, the bottom of the wider section (1*d*) of the shoulder (1*a*) rests on a first ledge (4*c*) of the container overshell. The top of the wider section (1*d*) of the shoulder (1*a*) sits below the top (4*a*) of the container overshell (4), and this creates a space in which are disposed one or more magnetic elements (9). These magnetic elements sit near the top (4*a*) of the container overshell (4). Throughout the specification, when we speak of any magnetic elements as being "near" a particular feature, we mean that some portion of the magnetic elements are within 2 centimeters of the indicated feature, more preferably within 1 centimeter, most preferably within 0.5 centimeters of the indicated feature.

Figure 4B:
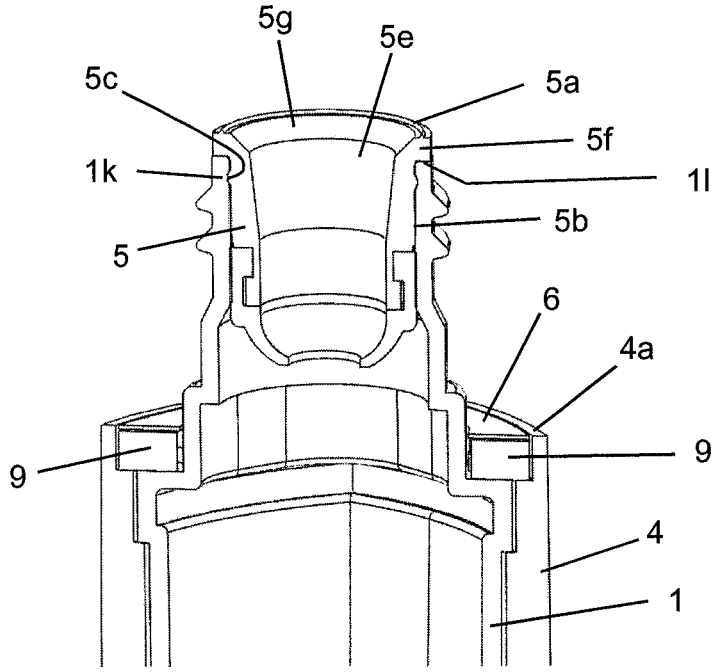
Figure 5:
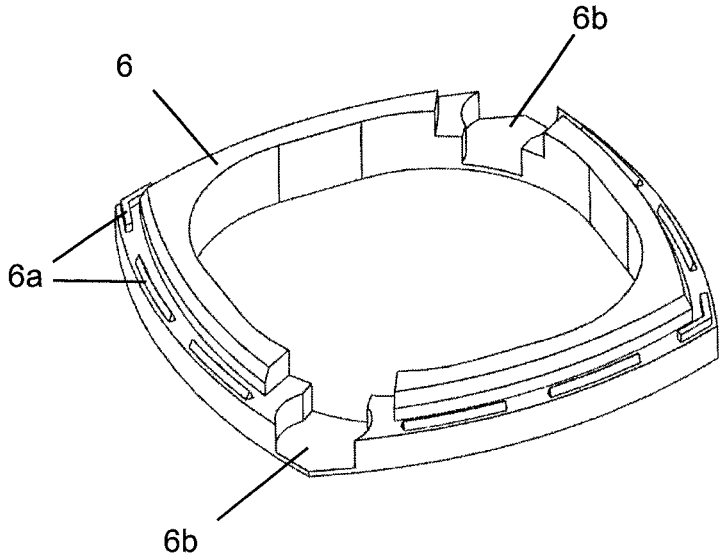
FIG. 5 is a bottom, perspective view of a collar (6) according to the present invention.

Optionally, but preferred, the one or more magnetic elements (9) are housed in a collar (6) which is disposed in the container overshell (4), near the top (4*a*) of the container overshell. For example, collar may be disposed in the space created by the shoulder (1*a*) and overshell (4). The collar rests on top of the wider section (1*d*) of the shoulder, as well as on a second ledge (4*d*) of the container overshell (4). A collar is shown in FIG. 5 (shown inverted). Ultrasonic welding ribs (6*a*) are provided to secure the collar in the container overshell. Alternatively, snap fitments or adhesive might be used to secure the collar to the container overshell (4). The collar is designed to give a finished appearance to the top of the overshell, as well as house one or more magnetic elements (9) in the spaces (6*b*). In FIGS. 2B and 4B, there are two magnetic elements located in spaces (6*b*) at two corners of the collar (6). FIG. 2A shows the fully assembled container (10). Although not visible in FIG. 2A, the magnetic elements (9) are located just below the surface of the collar, near the top (4*a*) of the container overshell (4). The thickness of the collar just above the magnetic elements must not be so great that the magnetic field is too attenuated to be useful. By experimentation, we know that a collar thickness above the spaces (6*b*) should not exceed about 0.3 mm. This thickness gives a good result with the magnets described herein. If the collar thickness at these points is greater than 0.3 mm, then the final packaging may not be functional with the preferred magnets described herein.

Closure

Figure 6A:
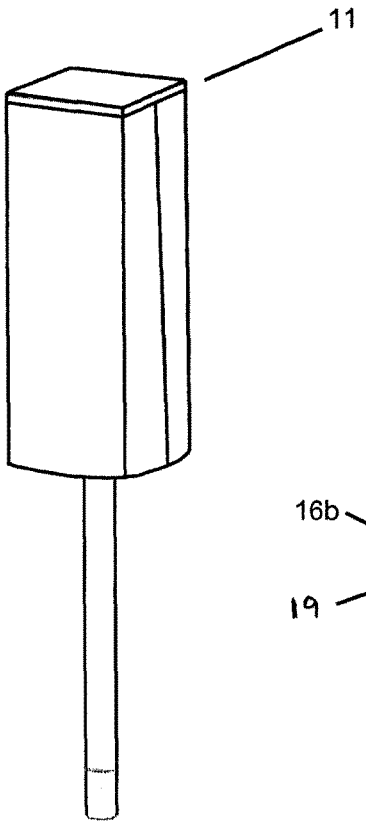
FIG. 6A is a perspective view of a closure (11) according to the present invention.
Figure 6B:
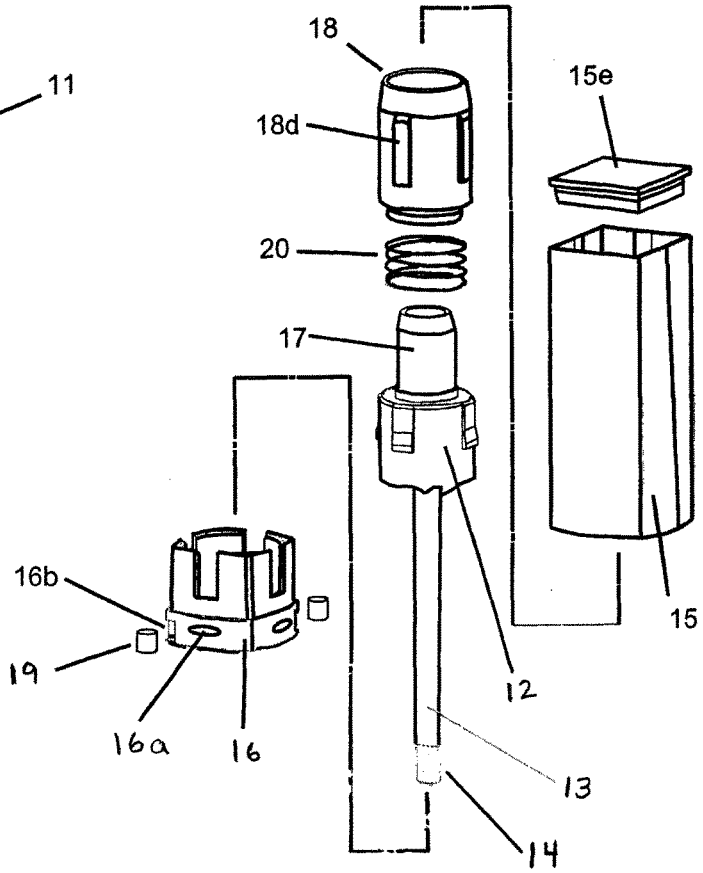
FIG. 6B is an exploded view thereof.

Referring to FIGS. 6A and 6B, one embodiment of a closure (11) according to the present invention comprises a screw-threaded inner cap (12), a wand (13) that depends from the inner cap and that is able to support an applicator surface (14) at its distal end. The closure (11) further comprises an overcap (15) that is enabled to translate axially relative to the inner cap, even when it is not rotating relative to the inner cap; and a cap insert (16) that houses one or more magnetic elements (19).

Overcap

The overcap (15) serves as a handle, and is generally be large enough to be comfortably gasped in the hand of a user. Handles for wand-type applicators are typically cylindrical, but may be any shape. In the figures, the overcap is shown as approximately square, with a uniform cross section. Typically, a characterizing dimension (such as a diameter or diagonal) of the overcap will measure from about 10 to about 30 mm. The length of the overcap (15) may typically range from about 20 mm to about 50 mm, but longer handles are also known.

Figure 7:
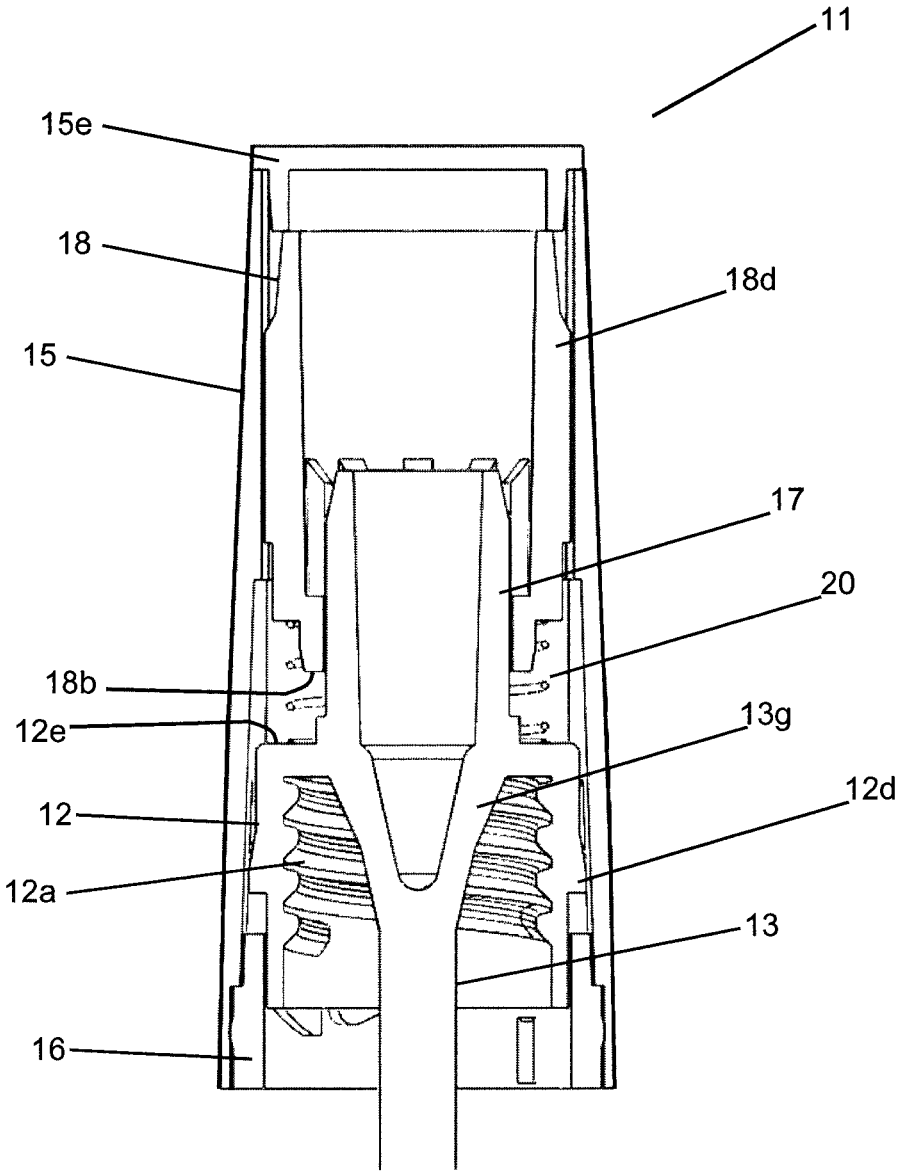
FIG. 7 is a cross sectional view of a closure (11) according to the present invention.
Figure 8:
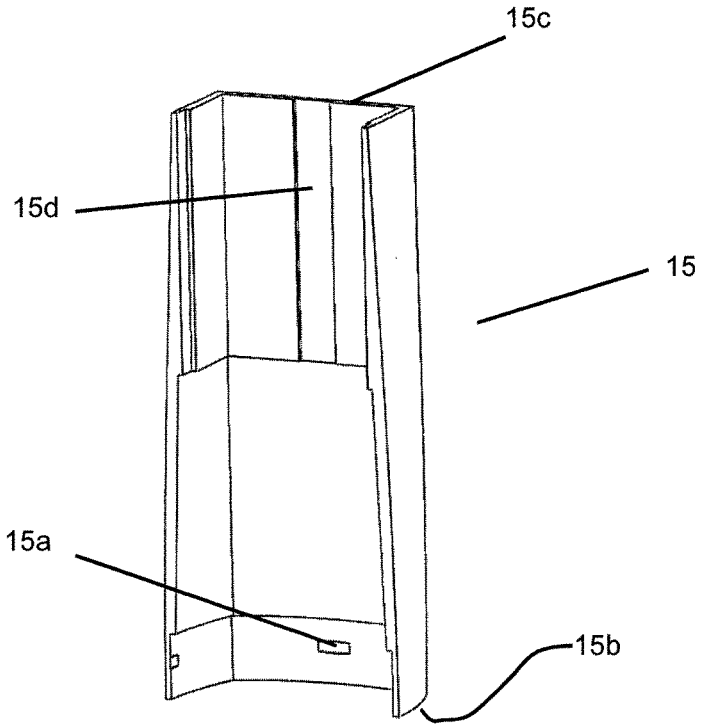
FIG. 8 depicts is a cut away view of one embodiment of an overcap (15) of the closure (11).

The distal end (15*b*) of the overcap is opened, and the proximal end (15*c*) is closed, either by integrally molding an end cap or by providing an end cap (15*e*) as a separate component which can be assembled to the overcap (15), as shown in FIGS. 6B and 7. A cutaway of the overcap is shown in FIG. 8. The interior of the overcap may comprise one or more channels (15*d*) located in the upper half of the overcap, and one or more detents (15*a*) located in near the opened, distal end (15*b*) of the overcap. These optional features will be explained below.

Referring to FIG. 7, the overcap (15) houses an inner cap (12), a cap insert (16) and a hollow cylinder (18). The cap insert and cylinder are optional, but preferred. When present, the cap insert and the cylinder are stationary with respect to the overcap. Also, the inner cap and overcap are stationary with respect to each other in rotation. However, the inner cap and overcap are able to translate up and down with respect to each other.

Inner Cap

Figure 10:
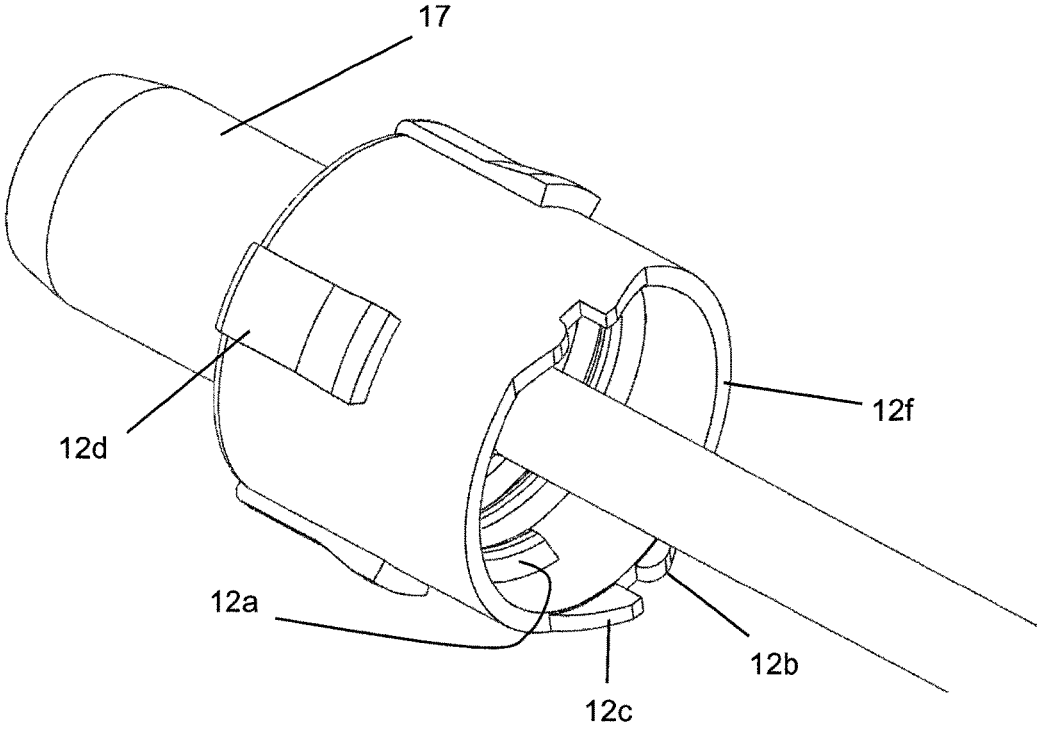
FIG. 10 is an enlarged view of an inner cap (12), showing the locking lug (12*b*) and closure stop (12*c*).

The inner cap (12) is that component of the closure (11) that makes a sealing engagement with the container (10), and supports the wand (13) and applicator surface (14). Referring to FIG. 10, the interior of the inner cap (12) is provided with screw threads (12*a*) that are designed to work in a sealing engagement with the screw threads (1*h*) of the threaded neck (1*g*). The bottom edge (12*f*) of the inner cap (12) is fitted with at least one locking lug (12*b*) and at least one cooperating closure stop (12*c*), which are designed to engage the container stops (1*f*). The screw threads and locking lugs define the rotational motion of the inner cap (12) relative to the container (10).

As noted above, the inner cap (12) and overcap (15) are able to slide up and down relative to each other. In preferred embodiments, the outer surface of the inner cap (12) is provided with one or more raised posts (12*d*). In the embodiment shown in the figures, there are four raised posts, evenly spaced around the inner cap (12). The raised posts are laterally constrained, however, the raised posts (12*d*) are able to slide up and down in the overcap (15). For example, if the optional cap insert (16) described below is present, then the raised posts (12*d*) are inserted into the slots (16*d*) of the cap insert, which prevent lateral movement of the raised posts. However, the raised posts are able to slide up and down within the slots (16*d*) of the cap insert (16). As a result, the inner cap (12) is able to slide up and down within the overcap (15), between a lower position and an upper position. Alternatively, it could be said that the overcap is able to slide over the inner cap, between a lower position and an upper position. Stops may be provided on the interior of the overcap to define the limits of vertical travel between the inner cap and overcap.

The Spring, Cylinder, Piston and Cap Insert

The movement of the inner cap (12) relative to the overcap (15) is effected by spring (20). The spring is disposed between the top surface (12*e*) of the inner cap and the inner surface of the end cap (15*e*), to urge the inner cap to slide down relative to the overcap. As we will see, when the closure (11) is screwed onto the container (10), a magnetic attraction is able to urge the overcap downward relative to the inner cap, and relative to the container (10). In that case, downward travel of the overcap ends when the bottom (15*b*) of the overcap (15) contacts the top (4*a*) of the container overshell (4).

Figure 11:
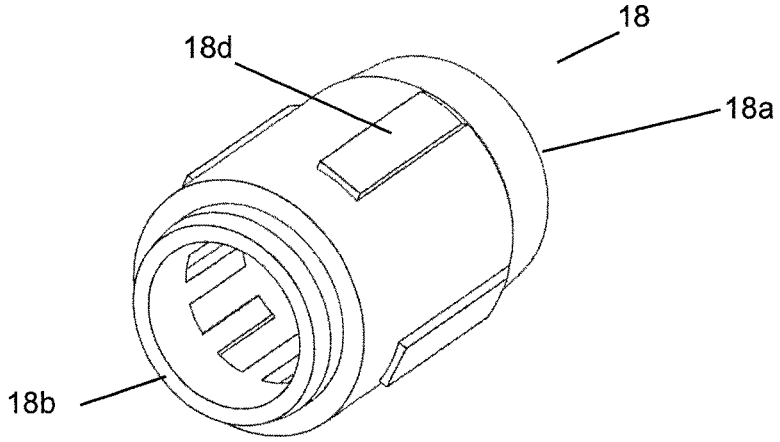
FIG. 11 depicts the hollow cylinder (18) of the closure (11).

Optionally, a cylinder (18) is housed in the overcap (15), and is stationary with respect to the overcap. A cylinder according to the invention is shown in FIG. 11. The cylinder has one or more raised posts (18*d*) that reside in the one or more channels (15*d*) of the overcap (15), located in the upper half of the overcap. The raised posts of the cylinder and the channels of the overcap assist in eliminating movement between those two components. When the cylinder is present, the top end of spring (20) presses against the bottom of the cylinder (18), and that force is transferred to the overcap (15).

Optionally, but preferred, a piston (17) rises from the top surface (12*e*) of the inner cap. When the piston is present, the spring (20) may be placed over the piston to help stabilize the spring. Also, the cylinder (18) may be rendered hollow, and opened at its top and bottom ends (18*a*, 18*b*), so that the piston (17) may enter into the bottom end of the cylinder, and slide up and down within the cylinder (see FIG. 7). The piston cooperates with the hollow cylinder (18) to effect the movement of the inner cap (12) relative to the overcap (15). In preferred embodiments, the inner cap (12), wand (13), and piston (17) are integrally molded as one component.

Figure 9:
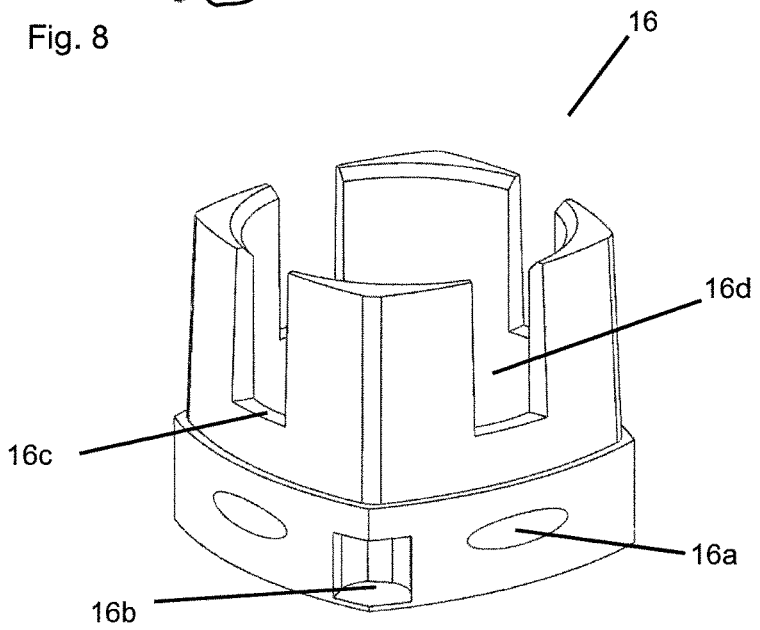
FIG. 9 is a perspective view of a cap insert (16) according to the present invention.

Optionally, but preferred, a cap insert (16) is shown in FIG. 9. The cap insert is situated near the distal, opened end (i.e. bottom, 15*b*) of the overcap (15). For example, in FIG. 7, the bottom of the insert (16) is flush with the bottom of the overcap (15). The cap insert is secured in the overcap by any suitable means, such as adhesive, a friction fit, a bead and groove, etc. The cap insert is stationary with respect to the overcap. In the embodiment of the figures, one or more bosses (16*a*) of the cap insert are held by one or more detents (15*a*) of the overcap, so that the insert (16) is fixed relative to the overcap (15), and the two components move as one member. A main purpose of the cap insert is to situate one or more magnetic elements (19) near the distal end (15*b*) of the overcap. For example, in FIG. 6B there are two magnetic elements (19) located in two spaces (16*b*) at two corners of the cap insert (16). When the cap insert is secured into the overcap, then the magnetic elements (19) are situated near the distal end of the overcap. More spaces (16*b*) could be provided for more magnetic elements. Alternatively, when the magnetic elements (19) are secured by some other means, then the cap insert may not be necessary. For example, the one or more magnetic elements (19) may be located near the distal end of the overcap (15) by attaching them to one or more inner surfaces of the overcap.

The cap insert (16) may further comprise one or more vertical slots (16*d*), which are opened at the top of the cap insert. The bottoms of the slots are denoted as (16*c*). In the embodiment shown in the figures, there are four vertical slots, evenly spaced around the cap insert (16). As discussed above, the slots assist in stabilizing the movement of the inner cap (12) within the overcap (15), because the raised posts (12*d*) of the inner cap are inserted into the slots (16*d*) of the cap insert, which prevents lateral movement of the raised posts.

When the cap insert (16), piston (17) and the cylinder (18) are all present (as is preferred), then the spring (20) is disposed over the piston, with one end pushing against the top surface (12*e*) of the inner cap (12), and the other end pushing against the cylinder (18), to urge the piston down and out of the cylinder. Because the cylinder is fixed to the overcap (15), and the piston is fixed to the inner cap (12), the spring urges the inner cap to slide down relative to the overcap (15). Maximum upward travel of the overcap is reached when the raised posts (12*d*) of the inner cap contact the bottom (16*c*) of the slots (16*d*) of the cap insert (16). This condition is reached when the closure (11) is loose, or not screwed onto the container (10). However, as we will see, when the closure is being screwed onto the container, a magnetic attraction between the two sets of magnetic elements (9, 19) is able to overcome the bias of the spring (20) and urge the overcap downward relative to container. In that case, downward travel of the overcap ends when the bottom (15*b*) of the overcap (15) contacts the top (4*a*) of the container overshell (4).

The Wiper, Wand and Applicator Surface

Referring to FIG. 4B, a wiper (5) is located, in the usual manner, in the neck (1*g*) of the reservoir (1), except for the flange (5*f*) of the wiper, which rests on the landing area (11) of the neck. The wiper has an upper opening (5*e*) and a lower opening (5*d*) which has a diameter. The wiper distributes product evenly on the applicator surface (14), and removes excess product from the applicator surface as the applicator surface is drawn through the wiper. The wiper is held in the neck by friction between an outer wall (5*b*) of the wiper and the inner wall of the neck (1*g*). For additional retention, the wiper may be provided with a bead (5*c*) that rests in a groove (1*k*) of the neck.

Up to now, we have described features of a conventional wiper, which may be suitable for some embodiments of the invention. However, when airtight sealing of the reservoir (1) must be guaranteed, it is preferable to use a custom wiper, as now described. In a custom wiper according to the present invention, the upper opening (5*e*) is surrounded by a beveled surface (5*g*) located just below the upper opening. Furthermore, a sealing lip (5*a*) may be provided on the flange, just above the upper opening. In some embodiments of the invention, the sealing lip is formed as a flat flap that encircles the upper opening (5*e*) of the wiper. As shown in the figures, however, the sealing lip is formed as a raised bead. The beveled surface (5*g*) and sealing lip (5*a*) interact with a custom applicator wand (13) to form an effective airtight seal. Preferably, the beveled surface (5*g*) and the sealing lip (5*a*) are molded from relatively flexible thermoplastic elastomers, such as polyurethanes or polyesters having a Shore hardness less than about 50. This flexibility improves the airtightness in the sealing zones of the beveled surface and sealing lip. It may also be preferable for the lower opening (5*d*) to be molded from relatively flexible thermoplastic elastomers. This is because molded brushes generally require a wiper orifice that is molded from flexible material to avoid any damage to the molded bristles during the wiping. FIG. 4A depicts a one piece wiper (5) made by single injection molding. On the other hand, wiper retention is improved when the wiper material is less flexible. Therefore, FIG. 4B depicts a wiper that is made by bi-injection molding. This allows the upper and lower portions of the wiper to have different flexibilities and hardness, when such would be desired.

When the present invention is practiced with a preferred custom wiper, then a custom wand (13) should also be used. Referring to FIG. 7, the wand depends from an inner surface of the inner cap (12). The lower portion of the wand is fashioned as an extended cylindrical rod (13*d*). The upper portion of the wand flares outwardly as a conic section (13*g*). The angle of the conic section is steeper than the angle of the beveled surface (5*g*) of the wiper (5). However, when the wand (13) is seated in the reservoir (1), then the conic section (13*g*) contacts the beveled surface (5*g*), the beveled surface flexes to more nearly match the angle of the conic section, and a sealing engagement is effected 360° around the beveled surface. To ensure good contact between the conic section of the wand (13) and the beveled surface (5*g*), the diameter of the conic section, at the level where the conic section of the wand contacts the beveled surface of the wiper (5), should be slightly larger than the diameter of the beveled surface. Generally the conic section (13*g*) and beveled surface (5*g*) will have an interference from about 0.1 mm to 0.25 mm, preferably about 0.15 mm. This interference provides an effective seal against leakage. By "effective seal" we mean sufficiently air tight and water tight for commercial purposes.

It is preferable if the diameter of the rod (13*d*) is slightly larger than the diameter of the lower opening (5*d*) of the wiper. This will ensure that excess product is wiped off of the rod by the wiper and creates and additional seal when the wand is stored in the reservoir (1). An applicator surface (14) is supported at the end of the rod (13*d*) of the wand (13). The applicator surface is able to take up product from the reservoir (1) and transfer it to the skin or hair of a user. The applicator surface may be any type of applicator head that is known to be used on a wand type applicator with a wiper system. These include, but are not limited to bristle brushes for mascara (as in FIG. 1), fiber brushes for nail polish (as in FIG. 6A) and doe foot applicators for creams, lotions and serums.

Magnetic Elements

As we have seen, one or more magnetic elements (9) are housed in the container (10), and one or more magnetic elements (19) are housed in the overcap (15). The magnetic elements of at least one of the container or overcap must have permanent (or at least long term) magnetization. A permanently magnetized component may be a simple bar magnet of cylindrical or rectangular cross section. If the magnetic elements of one of the container or overcap is not permanently magnetized, then those magnetic elements must be of a material that is attracted by a permanent magnet (i.e. of a ferromagnetic material). Examples of suitable ferromagnetic materials include iron, nickel, cobalt and alloys that contain ferromagnetic metals, such as steel. If the magnetic elements of both the container and overcap are permanently magnetized, then like poles in the container (11) should be as far as possible from like poles in the overcap (15). This is to maximize the magnetic attraction of the overcap for the container. Also, for maximum effect, each magnetic element (9, 19) should be oriented so that the poles of the magnetic element are aligned axially with the container (10) or overcap (15), as the case may be.

As the separation between the magnetic elements (9, 19) decreases (i.e. while the closure is being screwed down on the container), the combined force of attraction of the magnetic elements (9) for the magnetic elements (19) must be able to overcome the extension force of the spring (20). One preferred magnet is a cylindrical neodymium-iron-boron (NdFeB) magnet, having a 1 mm diameter, 7 mm height, and a magnetization grade of N45. Magnets having a lesser magnetization grade, such as at least N20, at least N25 or at least N30 may also be useful.

Function of the Screw-Type Closure Systems with Magnetic Feature

Figure 12A:
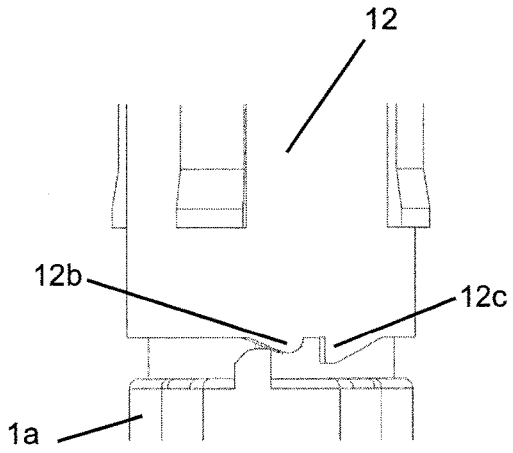
FIGS. 12A-C depict the engagement between one of the stops (1*f*) of the reservoir (1) with one locking lug (12*b*) and one closure stop (12*c*) of the inner cap (12).
Figure 12B:
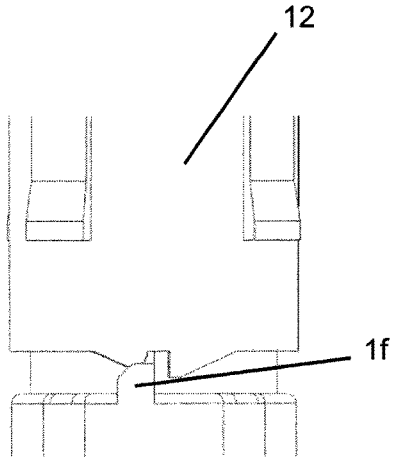
Figure 12C:
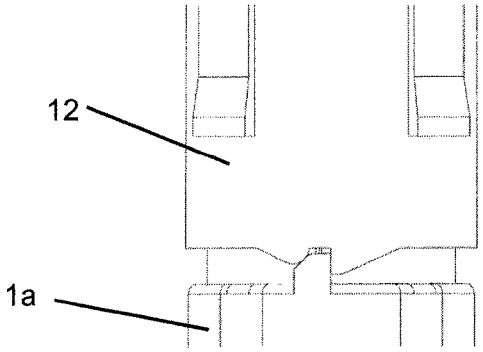

FIGS. 12A-C depict a close-up of the engagement between one of the stops (1*f*) of the reservoir (1) with one locking lug (12*b*) and one closure stop (12*c*) of the inner cap (12). As the closure (11) is screwed down onto the container (10), the locking lug (12*b*) approaches the container stop. There is enough play between the threads (12*a*) of the inner cap (12) and the threads (1*h*) of the container (10) to allow the locking lug (12*b*) to rise up and pass over the container stop. The closure stop (12*c*), however, is not able to pass over the container stop, and the container stop comes to rest in between the locking lug and the closure stop (see FIG. 12C). At this point the inner cap (12) is fully rotated onto the threaded neck (1*g*) of the container. Preferably, at this point the closure (10) makes an effective seal against the container (11). For example, when downward rotation of the closure is no longer possible, then sealing contact has already occurred between the conic section (13*g*) of the wand (13) and the beveled surface (5*g*) of the wiper, as described above.

Figure 13:
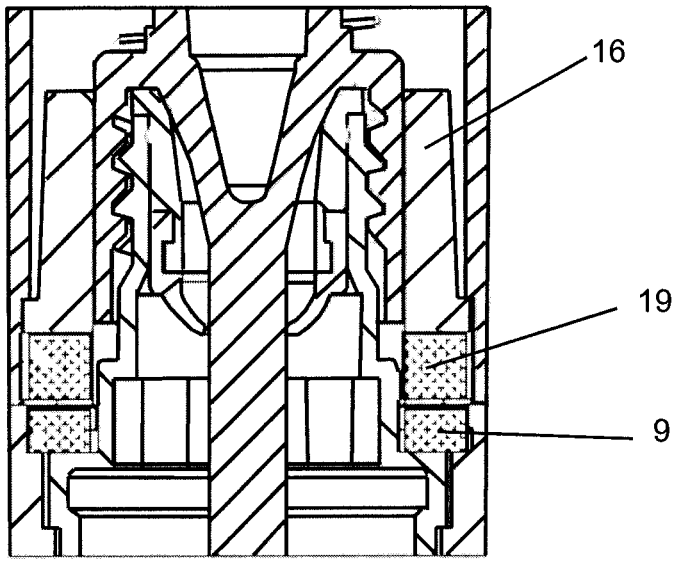
FIG. 13 shows the alignment of the magnetic elements (9) of the collar (6) and the magnetic elements (19) of the cap insert (16).

At the moment that downward rotation of the closure (11) is no longer possible, there may be a discernible, unsightly gap between the overcap (15) of the closure and the overshell (4) of the container (10) (see FIG. 1), due to the spring (20) urging these two components apart. However, the stops (1*f*) of the reservoir (1) and the stops (12*c*) of the inner cap (12) are positioned so that when downward rotation of the closure (11) is no longer possible, the magnetic elements (9) of the collar (6) are aligned with the magnetic elements (19) of the cap insert (16) (see FIG. 13). The distance between the two sets of magnetic elements is such that the magnetic force of attraction is sufficient to overcome the spring bias, and the overcap (15) is pulled downward toward to the overshell (4) until the two make contact, and the gap disappears.

The force of contact between the overcap (15) and overshell (4) is sufficient to make an audible clicking noise, and create a satisfying, reassuring metallic "click" sound, with a luxury feel. The downward travel of the overcap (15) is effected by magnetism, not by the user, and this provides the user with magical or luxurious sensation. In preferred embodiments, contact between the overcap and overshell only occurs after the downward rotation of the closure (11) stops. If it were to happen during rotation of the closure, a consumer might be confused into thinking that the reservoir was adequately sealed when it was not, or a consumer might not have an enjoyable experience. Therefore, it is preferable if the magnetic attraction of the two sets of magnetic elements (9, 19) is able to overcome the repulsion of the spring (20) only when the stops (1*f*) of the reservoir and the stops (12*c*) of the inner cap have engaged each other in the manner described above. The number and strength of the magnetic elements (9, 19) can be adjusted accordingly. For example, in the cap insert (16) depicted FIG. 6*b*, there are two spaces (16*b*) at opposite corners for magnetic elements (19), which will align with two magnetic elements (9) that occupy the two space (6*b*) in FIG. 5. Because the overcap (15) is able to slide downward independently of the inner cap (16), the present closure system ensures that there will be no gap between the container (10) and closure (11) when the package is in its closed configuration. Furthermore, the use of stops (1*f*) and (12*c*) to align the magnetic elements (9, 19) also allows the closure (11) to be precisely registered with the container (10). So, in the figures, the container and closure have a square cross section. Normally, it might be difficult to register the closure on the container so that the shape of one component flows smoothly into the other. But the stops (1*f*, 12*c*) enable that to be achieved easily.

Opening the reservoir proceeds in the usual manner. A user simply unscrews the closure (11) from the container (10). To effect a counter-clockwise rotation, a user must supply the force needed to overcome the magnetic force of attraction between the magnetic elements (9, 19), but this is not difficult. As the two sets of magnetic elements get further away from each other, the magnetic attraction weakens. As this happens, the spring (20) pushes the overcap (15) upward relative to the inner cap (12), until the inner cap reaches its lower position within the overcap.

What we claim is:

1. A screw-type container and closure system that has:

a container (10) that comprises a first subassembly:

the first subassembly comprises:

a reservoir (1) that is able to be filled with a product, and that has a threaded neck (1*g*) with screw threads (1*h*);

a container overshell (4) having a closed bottom (4*b*) and an opened top (4*a*) into which is disposed the reservoir; and one or more first magnetic elements (9) disposed near the top of the container overshell (4);

a closure (11) that comprises second and third subassemblies:

the second subassembly comprises:

an overcap (15) having an opened, distal end (15*b*), and a closed, proximal end (15*c*);

one or more second magnetic elements (19) located near the opened, distal end (15*b*) of the overcap (15);

the third subassembly comprises:

a screw-threaded inner cap (12) that is housed within the overcap (15), and that has a top surface (12*e*) and a bottom edge (12*f*);

a wand (13) that depends from an inner surface of the inner cap (12); and an applicator surface (14) that is supported at the end of the wand;

wherein:

the screw-threaded inner cap (12) and the overcap (15) are stationary with respect to each other in rotation, but the inner cap is able to slide up and down within the overcap (15), between a lower position and an upper position;

a spring (20) disposed between the inner cap (12) and the overcap (15), so as to urge the inner cap downward relative to the overcap; and when the screw-threaded inner cap (12) is fully rotated onto the threaded neck (1*g*), a magnetic attraction between the one or more first magnetic elements (9) disposed near the top of the container overshell (4) and the one or more second magnetic elements (19) located near the opened, distal end (15*b*) of the overcap (15) is sufficient to overcome the bias of the spring (20), and urge the overcap (15) downward until it contacts the container overshell (4).

2. A screw-type container and closure system according to claim 1 wherein:

the threaded neck (1*g*) rises from the top of a shoulder (1*a*);

the shoulder (1*a*) comprises one or more container stops (1*f*) that rise from the top of the shoulder; and the end of the screw threads (1*h*) of the neck (1*g*) are turned abruptly downward, in line with one of the container stops (1*f*).

3. A screw-type container and closure system according to claim 2 wherein the bottom edge (12*f*) of the inner cap (12) is fitted with at least one locking lug (12*b*) and at least one cooperating closure stop (12*c*), such that, as the closure (11) is screwed down onto the container (10), the locking lug (12*b*) passes over the container stop (1*f*), so that the container stop comes to rest in between the locking lug and the closure stop (12*c*).

4. A screw-type container and closure system according to claim 3 further comprising a wiper (5) is located in the neck (1*g*) of the reservoir (1), the wiper having an upper opening (5*e*), wherein the upper opening is surrounded by a beveled surface (5*g*) below the upper opening, and sealing lip (5*a*) above the upper opening.

5. A screw-type container and closure system according to claim 4 wherein an upper portion of the wand (13) flares outwardly as a conic section (13*g*), such that when the wand (13) is seated in the reservoir (1), then the conic section (13*g*) contacts the beveled surface (5*g*).

6. The screw-type container and closure system according to claim 4 wherein the beveled surface (5*g*) and the sealing lip (5*a*) are molded from thermoplastic elastomers that have a Shore hardness of less than 50.

7. The screw-type container and closure system according to claim 1 wherein the one or more first magnetic elements (9) are housed in a collar (6) which is disposed in the container overshell (4), near the top (4*a*) of the container overshell.

8. The screw-type container and closure system according to claim 7 wherein the second subassembly further comprises a hollow cylinder (18) housed in the overcap (15) so that it is stationary with respect to the overcap.

9. The screw-type container and closure system according to claim 8 wherein the one or more second magnetic elements (19) are housed in a cap insert (16) which is disposed in the overcap (15), near the opened, distal end (15*b*) of the overcap.

10. The screw-type container and closure system according to claim 9 wherein the third subassembly further comprises a piston (17) that rises from the top surface of the inner cap (12), wherein the piston (17) is able to slide up and down in the hollow cylinder (18), and the spring (20) is disposed over the piston, with one end of the spring pushing against the top surface (12*e*) of the inner cap (12), and the other end of the spring pushing against the cylinder (18).

11. The screw-type container and closure system according to claim 1 wherein the one or more first magnetic elements (9) have permanent magnetization.

12. The screw-type container and closure system according to claim 11 wherein the one or more first magnetic elements are neodymium-iron-boron (NdFeB) magnets, having a magnetization grade of at least N20.

13. The screw-type container and closure system according to claim 1 wherein the one or more second magnetic elements (19) have permanent magnetization.

14. The screw-type container and closure system according to claim 13 wherein the one or more second magnetic elements are neodymium-iron-boron (NdFeB) magnets, having a magnetization grade of at least N20.

* * * * *